US007495507B2

(12) United States Patent
Choi

(10) Patent No.: US 7,495,507 B2
(45) Date of Patent: Feb. 24, 2009

(54) CIRCUITS FOR GENERATING REFERENCE CURRENT AND BIAS VOLTAGES, AND BIAS CIRCUIT USING THE SAME

(75) Inventor: Hee-Cheol Choi, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 31 days.

(21) Appl. No.: 11/508,428

(22) Filed: Aug. 23, 2006

(65) Prior Publication Data

US 2007/0057717 A1 Mar. 15, 2007

(30) Foreign Application Priority Data

Aug. 23, 2005 (KR) ..... 10-2005-0077161

(51) Int. Cl.
*G05F 1/10* (2006.01)
*G05F 3/02* (2006.01)

(52) U.S. Cl. ..... 327/543; 327/538; 323/313; 323/315; 323/901

(58) Field of Classification Search ..... 327/538–543; 323/311–317, 901
See application file for complete search history.

(56) References Cited

U.S. PATENT DOCUMENTS 6,112,870 A 9/2000 Fukumoto
6,600,303 B2 7/2003 Ikehashi
6,844,773 B2 1/2005 Ishida et al.
6,933,769 B2 * 8/2005 Koelling ..... 327/538
2004/0046538 A1 * 3/2004 Sivero et al. ..... 323/315
2005/0046466 A1 * 3/2005 Koelling ..... 327/539

FOREIGN PATENT DOCUMENTS

JP 2004-062424 2/2004
KR 19990029934 4/1999
KR 1020020025690 A 4/2002

* cited by examiner

*Primary Examiner*—Lincoln Donovan
*Assistant Examiner*—Patrick O'Neill
(74) *Attorney, Agent, or Firm*—Mills & Onello, LLP

(57) ABSTRACT

A circuit for generating a reference current comprises: a first current mirror configured to current-mirror based on a second current, so as to generate a first current that is substantially in inverse proportion to a variation of a power supply voltage; a current compensation unit configured to remove a variation of the first current corresponding to the variation of the power supply voltage to form a compensated first current; a second current mirror configured to generate the second current based on the compensated first current, and configured to provide the second current to the first current mirror; and a current output unit configured to output the second current as the reference current.

18 Claims, 10 Drawing Sheets

CIRCUITS FOR GENERATING REFERENCE CURRENT AND BIAS VOLTAGES, AND BIAS CIRCUIT USING THE SAME

CROSS-REFERENCE TO RELATED APPLICATIONS

This application claims priority under 35 U.S.C. § 119(a) to commonly owned Korean Patent Application No. 10-2005-0077161 filed on Aug. 23, 2005, the contents of which are herein incorporated by reference in its entirety.

BACKGROUND OF THE INVENTION

1. Field of the Invention

The present invention relates to a circuit for generating a reference current, a circuit for generating a bias voltage and a bias circuit having the reference current generating circuit and the bias voltage generating circuit. More particularly, the present invention relates to a reference current generating circuit capable of generating a reference current constantly at a low voltage, and an amplifier bias circuit capable of providing an operational amplifier with a constant bias voltage based on the reference current.

2. Description of the Related Art

An operational amplifier (hereinafter referred to as an "op-amp") is widely used in various analog circuits for analog operations or analog amplifications. Analog circuits, which have been used in mobile devices, need to be configured to save electricity and cost in manufacturing process and operation. Recently, op-amps tend to be designed to operate at a low voltage, as low as 1.2V, to be implemented in mobile devices. However, conventional bias circuits for op-amps still require 3V as a power supply voltage due to performance deterioration when operated at 1.2V.

Korean Patent Laid-Open Publication No. 1999-0029934 discloses a reference current circuit that purports to be capable of generating a constant current regardless of variation in power supply voltages and ambient temperature. The reference current circuit includes a first unit to generate a current in inverse proportion to the temperature variation, and a second unit to generate a current in proportion to the temperature variation so as to generate a regulated current. However, the first unit of the reference current circuit has a circuit configuration that makes the circuit difficult to operate properly at a low power supply voltage. If a circuit is made with a smaller dimension, the above reference current circuit may be operated at a low power supply voltage, but technologies for finer processes would be required.

Typically, because resistances of circuit elements increase in proportion to ambient temperature, it is desirable to compensate effects from the increased resistances by increasing the reference current accordingly for stability of the whole device. Therefore, in many cases, only the above second unit is used for generating a reference current, without using the first unit.

FIG. 1 is a circuit diagram illustrating a conventional reference current generating circuit 100. Referring to FIG. 1, the reference current generating circuit generates a current in proportion to temperature variation.

The reference current generating circuit includes a current generating unit 11 with a positive temperature coefficient, a start-up unit 12 and a current output unit 13. The reference current generating circuit has a current property, which functions independently from a power supply voltage VDD when operating at an ordinary range of the power supply voltage, i.e., 2.5V~3.3V. An output current $I_{OUT}$ may be represented by:

$$I_{OUT} = \frac{2 \times L_{MP2}}{R^2 \mu_p C_{OX} W_{MP2}} \left(1 - 1/\sqrt{A}\right)^2, \qquad \text{Equation (1)}$$

where $$A = \left(\frac{L_{MP1}}{W_{MP1}} \Big/ \frac{L_{MP2}}{W_{MP2}}\right),$$

L denotes a length of a gate of a MOS transistor, W denotes a width of the gate of the MOS transistor, $\mu_p$ denotes a mobility of an electric hole, and $C_{OX}$ denotes a capacitance of a gate oxide per unit area.

FIG. 2 is a schematic diagram illustrating a conventional operational amplifier 200. Particularly, a circuit in FIG. 2 is a folded-cascode op-amp, the most popular type of op-amps fabricated by the CMOS technologies, having a common-mode feedback (CMFB) circuit. Referring to FIG. 2, the folded-cascode op-amp includes a differential amplifier 21 having differential inputs and outputs, and a biasing unit 22 for biasing the differential outputs.

The biasing unit 22 and the CMFB respectively require first through fifth, bias voltages VBS1, VBS2, VBS3, VBS4 and VBS5. Thus the folded-cascode op-amp still needs an additional circuit to constantly provide such bias voltages. Particularly, a voltage difference between the first and third bias voltages VBS1 and VBS3, a voltage difference between the second and third bias voltages VBS2 and VBS3, and a voltage difference between the fourth and fifth bias voltages VBS4 and VBS5 are important for the operations of the biasing unit 22 and the CMFB. Such voltage differences need to be maintained constant, otherwise, the op-amp may not properly operate with a low power supply voltage.

FIG. 3 is a circuit diagram illustrating a bias voltage generating circuit 300 for the conventional operational amplifier in FIG. 2. Referring to FIG. 3, the bias voltage generating circuit may be generally viewed as six current mirrors, mirroring currents with respect to a seventh PMOS transistor MP7.

A reference current $I_{OUT}$ flows through the seventh PMOS transistor MP7 from a reference current generating circuit (not shown). The first to third PMOS transistors MP1 to MP3 respectively form current mirrors with the seventh PMOS transistor MP7, and currents flow through the first to third PMOS transistors MP1 to MP3 according to a size ratio of each PMOS transistor. These currents respectively flow through first to third diode-connected NMOS transistors MN1, MN2 and MN3, so that the bias voltage VBS1, VBS2 and VBS3 are generated according to respective equivalent impedances of the first to third NMOS transistors MN1 to MN3. A sixth PMOS transistor and a sixth NMOS transistor are operated as buffers to change levels of bias voltages to be generated. Fourth and fifth NMOS transistors MN4 and MN5 respectively mirror a current flowing through the sixth NMOS transistor MN6. These mirrored currents respectively flow to the fourth and fifth PMOS transistors MP4 and MP5, so that the bias voltages VBS4 and VBS5 are generated according to respective equivalent impedances of the fourth and fifth PMOS transistors MP4 and MP5.

In the bias voltage generating circuit, the bias voltages are dependent on the equivalent output impedances of the transistors MP1 MP2, MN3, MN4 and MN5 that are operated as loads. The output impedances, which are presented by the channel length modulation, may be adjusted by changing size of gates in the MOS transistors. When the bias voltage generating circuit in FIG. 2 is operated with power supply voltages within a usual range, i.e., 2.5V~3.3V, the output impedance may be maintained steady regardless of variation of the power supply voltage, and the bias voltages may also be maintained steady.

When the bias voltage generating circuit in FIG. 2 is operated within a low range of power supply voltage, i.e., 1.0V~1.2V, not only the reference current, but also the output impedances may become dependent on the level of the power supply voltage. Thus, the bias voltages are not well maintained and the operation of the op-amp is badly affected.

Additionally, because it is hard to precisely control the output impedances of the load transistors by the CMOS technologies, the bias voltages may not be generated as designed.

SUMMARY OF THE INVENTION

In accordance with one aspect of the present disclosure, provided is a circuit for generating a reference current that includes a first current mirror, a current compensation unit, a second current mirror and a current output unit. The first current mirror generates a first current that is substantially in inverse proportion to a variation of a power supply voltage. The current compensation unit removes a variation of the first current corresponding to the variation of the power supply voltage to form a compensated first current. The second current mirror generates the second current based on the compensated first current and provides the second current to the first current mirror. The current output unit outputs the second current as the reference current.

The current compensation unit may be configured to substantially remove an increment of the first current, which increases in inverse proportion to the power supply voltage.

The first current mirror may include a first PMOS transistor having a body coupled to its own source, a feedback resistor coupled between the source of the first PMOS transistor and the power supply voltage, and a second PMOS transistor that has a gate and a drain both coupled to a gate of the first PMOS transistor, and a source coupled to the power supply voltage.

The second current mirror can comprise a third NMOS transistor having a gate and a drain both coupled to a drain of the first PMOS transistor, and a source coupled to a reference voltage. And can further include a fourth NMOS transistor having a gate coupled to the gate of the third NMOS transistor, a drain coupled to the drain of the second PMOS transistor, and a source coupled to the reference voltage.

The current compensation unit may include a fifth NMOS transistor that has a gate coupled to the drain of the second PMOS transistor, a drain coupled to the drain of the first PMOS transistor, and a source coupled to the reference voltage.

The circuit may be provided with the power supply voltage, which can be provided within a range between the saturation region and the triode region of the PMOS transistors and the NMOS transistors.

The circuit may further include a start-up unit that activates the first current mirror and the second current mirror right after a power-up.

In accordance with another aspect of the present disclosure, provided is a circuit for generating a reference current that includes a current generating unit that has a self-biased current source generating a first current that varies substantially in inverse proportion to variation of a power supply voltage; and a current compensation unit configured to remove a variation of the first current corresponding to the variation of the power supply voltage to from a compensated first current, and to thereby provide the compensated first current as the reference current.

The current compensation unit can be configured to substantially remove an increment of the first current that increases in inverse proportion to the power supply voltage.

The self-biased current source can comprise a first PMOS transistor having a body coupled to its own source and a feedback resistor coupled between the source of the first PMOS transistor and the power supply voltage.

The circuit can be provided with the power supply voltage, and the power supply voltage can be provided within a range between the saturation region and the triode region of the PMOS transistors and the NMOS transistors.

The circuit can further comprise a start-up unit configured to activate the first current mirror and the second current mirror after a power-up and a current output unit configured to output the compensated first current as the reference current.

In accordance with another aspect of the present disclosure, provided is a circuit for generating bias voltages that includes an input transistor configured to receive a reference current and at least one bias branch. The bias branch may include a first load; a second load that is coupled in serial with the first load; and a mirroring transistor configured to form a current mirror with the input transistor for providing the first and second loads with a mirror current that is dependent on the reference current, in which the bias voltages are respectively output from one or more of a junction of the second load and the mirroring transistor, and a junction of the first load and the second load.

The circuit for generating bias voltages can further include an additional bias branch, and a buffer that delivers a current based on the reference current from one bias branch to another bias branch by current-mirroring the current. The bias branches may include first, second and third bias branches. The first bias branch includes a first mirroring transistor that forms a current mirror with the input transistor to provide a first mirror current that is dependent on the reference current, for a first passive load and a first active load. Here, the first active load is coupled in serial with the first passive load, in which the first branch outputs a first bias voltage from a junction of the first passive load and the first active load. The second bias branch includes a second mirroring transistor that forms a current mirror with the input transistor to provide a second mirror current, which is dependent on the reference current, for a second passive load and a second active load. Here, the second active load can be coupled in serial with the second passive load, in which the second branch outputs a second bias voltage from a junction of the second passive load and the second active load, and a third bias voltage from a junction of the second passive load and the second mirroring transistor. The buffer branch includes a third mirroring transistor that forms a current mirror with the input transistor to provide a third mirror current that is dependent on the reference current for a third passive load and a third active load coupled in serial with the third passive load. The third bias branch includes a fourth mirroring transistor that forms a current mirror with the third active load to provide a fourth mirror current that is dependent on the third mirror current for a fourth passive load and a fourth active load. Here, the fourth active load can be coupled in serial with the fourth passive load, in which the fourth branch outputs a fourth bias voltage from a junction of the fourth passive load and the fourth active load, and a fifth bias voltage from a junction of the fourth passive load and the fourth mirroring transistor.

In another aspect of the present disclosure, provided is a bias circuit that includes the circuit for generating bias voltages based on a reference current and a reference current generating circuit configured to generate a reference current. The reference current generating circuit includes a first current mirror for current-mirroring based on a second current to generate a first current that is substantially in inverse proportion to a variation of a power supply voltage; a current compensation unit configured to remove a variation of the first current corresponding to the variation of the power supply voltage to form a compensated first current. The reference current generating circuit further includes a second current mirror configured to generate the second current based on the compensated first current and to provide the second current to the first current mirror; and a current output unit configured to output the second current as the reference current.

The current compensation unit can be configured to substantially remove an increment of the first current that increases in inverse proportion to the power supply voltage.

The first current mirror can comprise a first PMOS transistor having a body coupled to its own source; a feedback resistor coupled between the source of the first PMOS transistor and the power supply voltage; and a second PMOS transistor having a gate and a drain both coupled to a gate of the first PMOS transistor, and a source coupled to the power supply voltage.

The second current mirror can comprise a third NMOS transistor having a gate and a drain both coupled to a drain of the first PMOS transistor, and a source coupled to a reference voltage; and a fourth NMOS transistor having a gate coupled to the gate of the third NMOS transistor, a drain coupled to the drain of the second PMOS transistor, and a source coupled to the reference voltage.

The current compensation unit can comprise a fifth NMOS transistor having a gate coupled to the drain of the second PMOS transistor, a drain coupled to the drain of the first PMOS transistor, and a source coupled to the reference voltage.

The reference current generating circuit can be provided with the power supply voltage, which can be provided within a range between the saturation region and the triode region of the PMOS transistors and the NMOS transistors. The reference current generating circuit can further comprise a start-up unit configured to activate the first current mirror and the second current mirror after power-up.

The circuit for generating bias voltages can further include an additional bias branch, and a buffer that delivers a current based on the reference current from one bias branch to another bias branch by current-mirroring the current. The bias branches may include first, second and third bias branches. The first bias branch includes a first mirroring transistor that forms a current mirror with the input transistor to provide a first mirror current that is dependent on the reference current, for a first passive load and a first active load. Here, the first active load is coupled in serial with the first passive load, in which the first branch outputs a first bias voltage from a junction of the first passive load and the first active load. The second bias branch includes a second mirroring transistor that forms a current mirror with the input transistor to provide a second mirror current, which is dependent on the reference current, for a second passive load and a second active load. Here, the second active load can be coupled in serial with the second passive load, in which the second branch outputs a second bias voltage from a junction of the second passive load and the second active load, and a third bias voltage from a junction of the second passive load and the second mirroring transistor. The buffer branch includes a third mirroring transistor that forms a current mirror with the input transistor to provide a third mirror current that is dependent on the reference current for a third passive load and a third active load coupled in serial with the third passive load. The third bias branch includes a fourth mirroring transistor that forms a current mirror with the third active load to provide a fourth mirror current that is dependent on the third mirror current for a fourth passive load and a fourth active load. Here, the fourth active load can be coupled in serial with the fourth passive load, in which the fourth branch outputs a fourth bias voltage from a junction of the fourth passive load and the fourth active load, and a fifth bias voltage from a junction of the fourth passive load and the fourth mirroring transistor.

In accordance with another aspect of the present disclosure, provided is a bias circuit that includes the circuit for generating bias voltages based on a reference current and a reference current generating circuit configured to generate a reference current. The reference current generating circuit includes a current generating unit including a self-biased current source that generates a first current that varies substantially in inverse proportion to a variation of a power supply voltage, and a current compensation unit configured to remove a variation of the first current corresponding to the variation of the power supply voltage to form a compensated first current, and to thereby provide the compensated first current as the reference current.

The current compensation unit can be configured to substantially remove an increment of the first current that increases in inverse proportion to the power supply voltage.

The current generating unit can comprise a first PMOS transistor having a body coupled to its own source; a feedback resistor coupled between the source of the first PMOS transistor and the power supply voltage; and a second PMOS transistor having a gate and a drain both coupled to a gate of the PMOS transistor, and a source coupled to the power supply voltage.

The reference current generating circuit can further comprise a third NMOS transistor having a gate and a drain both coupled to a drain of the first PMOS transistor, and a source coupled to a reference voltage; and a fourth NMOS transistor having a gate coupled to the gate of the third NMOS transistor, a drain coupled to the drain of the second PMOS transistor, and a source coupled to the reference voltage.

The current compensation unit can comprise a fifth NMOS transistor having a gate coupled to the drain of the second PMOS transistor, a drain coupled to the drain of the first PMOS transistor, and a source coupled to the reference voltage.

The reference current generating circuit can be provided with the power supply voltage, which can be provided within a range between the saturation region and the triode region of the PMOS transistors and the NMOS transistors.

The reference current generating circuit can further comprise a start-up unit configured to activate the first current mirror and the second current mirror right after a power-up.

The bias circuit may further comprises an additional bias branch, and a buffer branch configured to deliver a current based on the reference current from one bias branch to another bias branch by current-mirroring the current.

The bias branches may include first, second and third bias branches. The first bias branch includes a first mirroring transistor that forms a current mirror with the input transistor to provide a first mirror current that is dependent on the reference current, for a first passive load and a first active load that is coupled in serial with the first passive load, wherein the first branch outputs a first bias voltage from a junction of the first passive load and the first active load. The second bias branch includes a second mirroring transistor that forms a current mirror with the input transistor to provide a second mirror current that is dependent on the reference current, for a second passive load and a second active load that is coupled in serial with the second passive load, wherein the second branch outputs a second bias voltage from a junction of the second passive load and the second active load and a third bias voltage from a junction of the second passive load and the second mirroring transistor. The buffer branch includes a third mirroring transistor that forms a current mirror with the input transistor to provide a third mirror current that is dependent on the reference current for a third passive load and a third active load coupled in serial with the third passive load. The third bias branch includes a fourth mirroring transistor that forms a current mirror with the third active load to provide a fourth mirror current that is dependent on the third mirror current with a fourth passive load and a fourth active load that is coupled in serial with the fourth passive load, wherein the fourth branch outputs a fourth bias voltage from a junction of the fourth passive load and the fourth active load and a fifth bias voltage from a junction of the fourth passive load and the fourth mirroring transistor.

DESCRIPTION OF THE EMBODIMENTS

Figure 1:
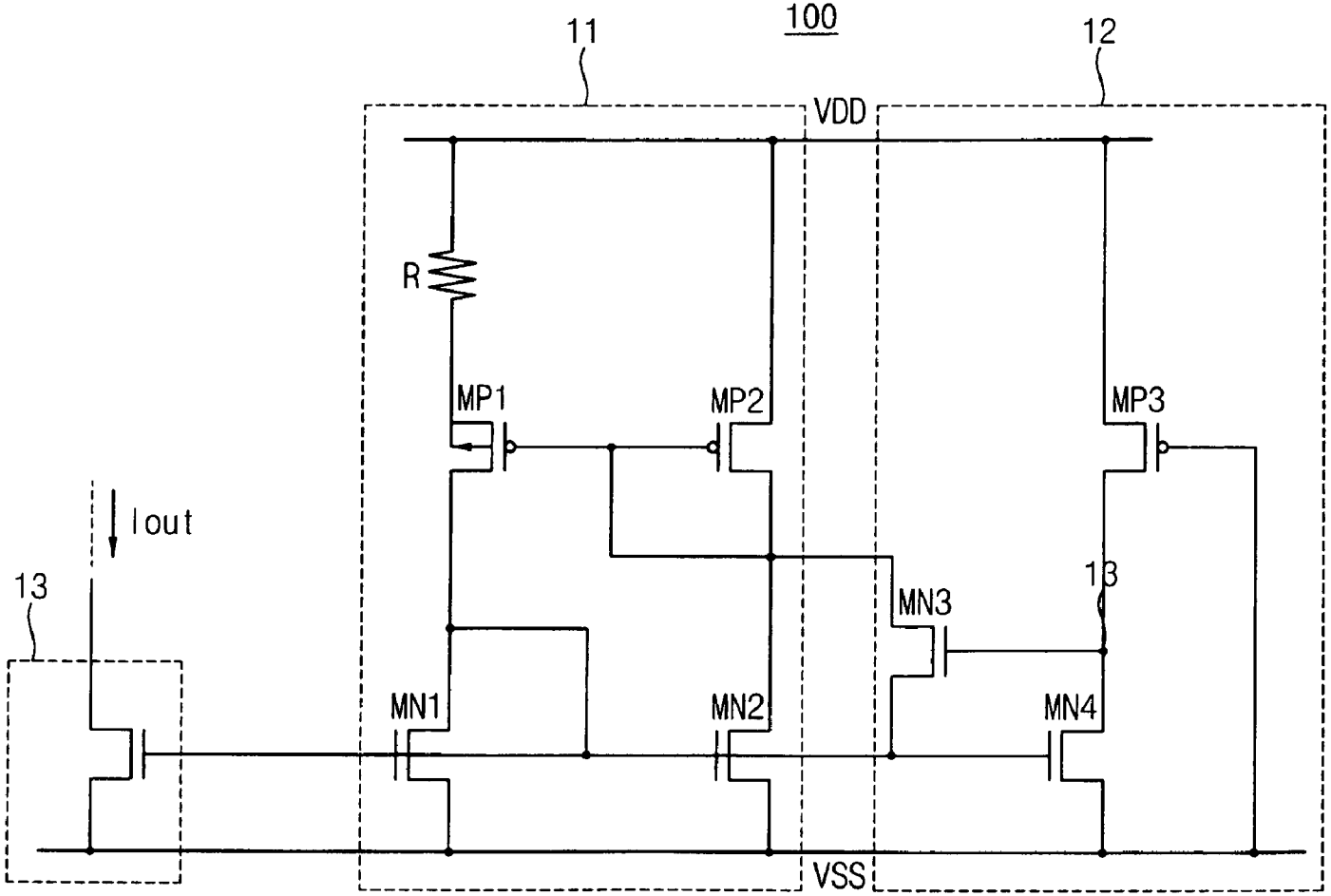
FIG. 1 (PRIOR ART)
FIG. 1 is a circuit diagram illustrating a conventional reference current generating circuit.

Presently preferred embodiments of the invention, or aspects thereof, are described hereinafter with reference to the accompanying drawings. This invention may, however, be embodied in many different forms and should not be construed as limited to the embodiments set forth herein. In the drawings, the size and relative sizes of blocks and regions may be exaggerated for clarity or reduced for simplicity.

It will be understood that when an element or block is referred to as being "on," "connected to" or "coupled to" another element or block, it can be directly on, connected or coupled to the other element or block or intervening elements or blocks may be present. In contrast, when an element is referred to as being "directly on," "directly connected to" or "directly coupled to" another element or block, there are no intervening elements or blocks present. Like numbers refer to like elements throughout. As used herein, the term "and/or" includes any and all combinations of one or more of the associated listed items.

It will be understood that, although the terms first, second, etc. may be used herein to describe various elements, components, regions, blocks and/or sections, these elements, components, regions, blocks and/or sections should not be limited by these terms. These terms are only used to distinguish one element, component, region, block or section from another region, block or section. Thus, a first element, component, region, block or section discussed below could be termed a second element, component, region, block or section without departing from the teachings of the present disclosure.

The terminology used herein is for the purpose of describing particular embodiments or aspects thereof and is not intended to be limiting of the invention. As used herein, the singular forms "a," "an" and "the" are intended to include the plural forms as well, unless the context clearly indicates otherwise. It will be further understood that the terms "comprises" and/or "comprising," when, used in this specification, specify the presence of stated features, integers, steps, operations, elements, and/or components, but do not preclude the presence or addition of one or more other features, integers, steps, operations, elements, components, and/or groups thereof.

Figure 4:
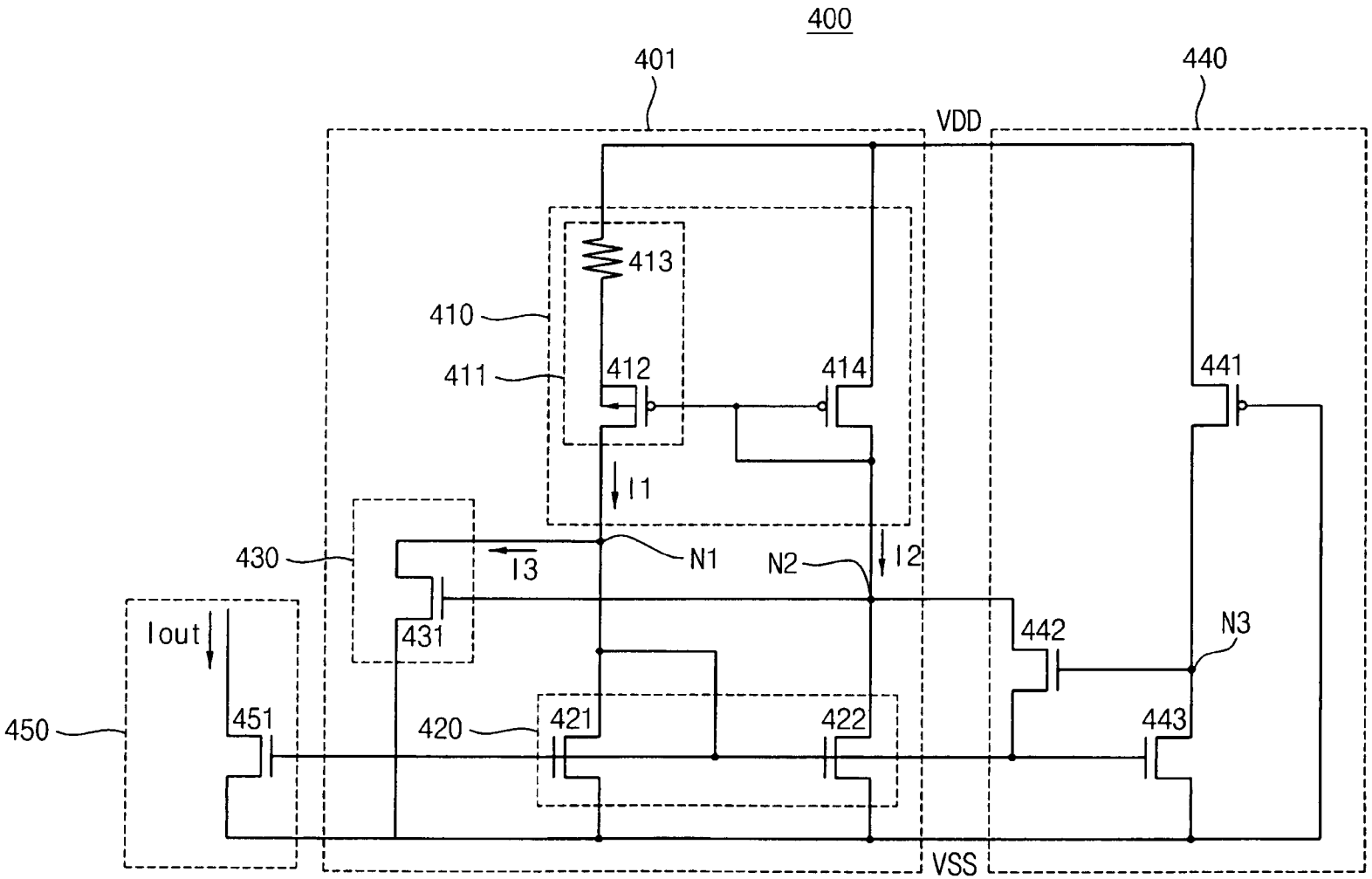
FIG. 4 is a circuit diagram illustrating a reference current generating circuit according to example embodiments of the present disclosure.

FIG. 4 is a circuit diagram illustrating an exemplary embodiment of a reference current generating circuit 400. Referring to FIG. 4, the reference current generating circuit includes a constant current generator 401, and further includes a start-up unit 440 for assisting the constant current generator 401 to settle right after a power-up, and/or a current output unit 450 configured to output the constant current as a reference current.

Following power-up, an initial state of the reference current generating circuit 400 may be uncertain. When a first node N1 has a relatively low voltage level and, at the same time, a second node N2 has a relatively high voltage level, the constant current generator 401 may not operate properly. For such a case, the start-up unit 440 may increase the voltage level at the first node N1, and at the same time lower the voltage level at the second node N2. If the initial state of the reference current generating circuit is as substantially desired after the power-up, the start-up unit 440 is not required to influence the operation of the constant current generator 401.

In this embodiment, the start-up unit 440 can operate as follows. After the power-up, a third PMOS transistor 441 is turned on, because its gate is coupled to a reference voltage VSS. The reference voltage VSS may be in a ground level or a negative level, for example. A voltage level of a drain in the third PMOS transistor 441 approaches a level of a power supply voltage VDD, and an eighth NMOS transistor 442 becomes turned on. The eighth NMOS transistor 442 may be purposely designed to have high output impedance. The eighth NMOS transistor 442 causes the voltage levels of the first and second nodes N1 and N2 to become equal to each other.

The voltage level of the first node N1 is increased to turn on all of the NMOS transistors 412, 422, 443 and 451 that are commonly coupled to the first node N1. After being turned on, the seventh NMOS transistor 443 shares the power supply voltage with the third PMOS transistor 441. The third PMOS transistor 441 has a high output impedance large enough for the eighth NMOS transistor 442 to get turned off by a voltage level of a third node N3, which has a voltage level determined from dividing a voltage between the seventh NMOS transistor 443 and the third PMOS transistor 441. The first and second nodes N1 and N2, which had the same high voltage level, will have different voltage levels due to the deactivation of the eighth NMOS transistor 442. As described above, the start-up unit 440 controls the voltage level of the second node N2 shortly after the power-up, and then becomes deactivated so as not to influence the operation of the constant current generator 401. When the output impedance of the third PMOS transistor 441 is set high, an electricity consumption of the start-up unit 440 becomes negligible.

The constant current generator 401 includes a first current mirror 410, a second current mirror 420 and a current compensation unit 430. The current compensation unit 430 can be disregarded, or assumed not to be present. Under this assumption, the first mirror 410 and the second mirror 420 are connected to each other at the first node N1 and the second node N2, and as a result provide each other with reference currents with which the first mirror 410 and the second mirror 420 are operable as current mirrors. In other words, the first current mirror 410 outputs a first current I1 to the second current mirror 420 by current-mirroring based on a second current I2 that is output from the second current mirror 420. The second current mirror 420 outputs the second current I2 to the first current mirror 410 by current-mirroring based on the first current I1 that is output from the first current mirror 410. Particularly, the first current mirror 410 can include a self-biased current source 411, so that the first current mirror 410 has a current that is substantially independent of the current of the second current mirror 420.

The current compensation unit 430 in the constant current generator 401 diverts part of the first current I1 as a compensating current I3, which will be described in detail. Therefore, the second current mirror 420 current-mirrors based on a current obtained by compensating the first current I1 from the first current mirror 410 with the compensating current I3.

The first current mirror 410 may include a first PMOS transistor 412, a second PMOS transistor 414 and a feedback resistor 413, according to the exemplary embodiment. The first PMOS transistor 412 has a gate coupled to a gate of the second PMOS transistor 414, and a source coupled to an end of the feedback resistor 413. The second PMOS transistor 414 has a gate coupled to a drain of its own, and a source coupled to the power supply voltage VDD. The other end of the feedback resistor 413 is coupled to the power supply voltage VDD. The first PMOS transistor can be fabricated by an N-well process and can have a body directly coupled to its own source.

The second current mirror 420 may include third and fourth NMOS transistors 421 and 422, according to the exemplary embodiment. The third NMOS transistor 421 has a gate coupled to its own drain and a source coupled to the reference voltage VSS, and the drain coupled to the drain of the first PMOS transistor 412. The fourth NMOS transistor 422 has a gate coupled to the gate of the third NMOS transistor 421, a source coupled to the reference voltage VSS and a drain coupled to the drain of the second PMOS transistor 414 in the first current mirror 410.

The second current mirror 420 acts substantially as a current source for the first current mirror 410. The constant current generator 401 may be viewed as a circuit that generates a current using the self-biased current 411.

The current compensation unit 430 may include a fifth NMOS transistor 431, according to the exemplary embodiment. The fifth NMOS transistor 431 has a gate coupled to the second node N2, a drain coupled to the first node N1, and a source coupled to the reference voltage VSS.

The current output unit 450 includes a sixth NMOS transistor 451, which outputs a reference current obtained by current-mirroring with the third NMOS transistor 421.

With the power supply voltage VDD in a commonly used range, the constant current generator 401 operates as follows. After the voltage level of the first node N1 is settled properly by the start-up unit 440, currents flow through each of the transistors according to each gate-source voltage. Particularly, the first PMOS transistor is configured to be self-biased. That is, when a current flowing through the first PMOS transistor 412 increases, a voltage across the feedback resistor 413 also increases and the gate-source voltage of the first PMOS transistor 412 drops. The current flowing through the first PMOS transistor 412 decreases accordingly. When the current flowing through the first PMOS transistor 412 decreases, the voltage across the feedback resistor 413 also drops and the gate-source voltage of the first PMOS transistor 412 increases. The current flowing through the first PMOS transistor 412 increases accordingly. As indicated by the above operations, the first PMOS transistor 412 serves as a constant current generator with respect to the second current mirror 420, and substantially maintains each of the currents in the entire constant current generator 401. Accordingly, the first PMOS transistor 412, which is associated with the feedback resistor 413, may be held as the self-biased current source 411.

When the power supply voltage is lower than the usual range, however, the transistors in the constant current generator 401 may cause problems, as described below with respect to FIG. 5.

Figure 5:
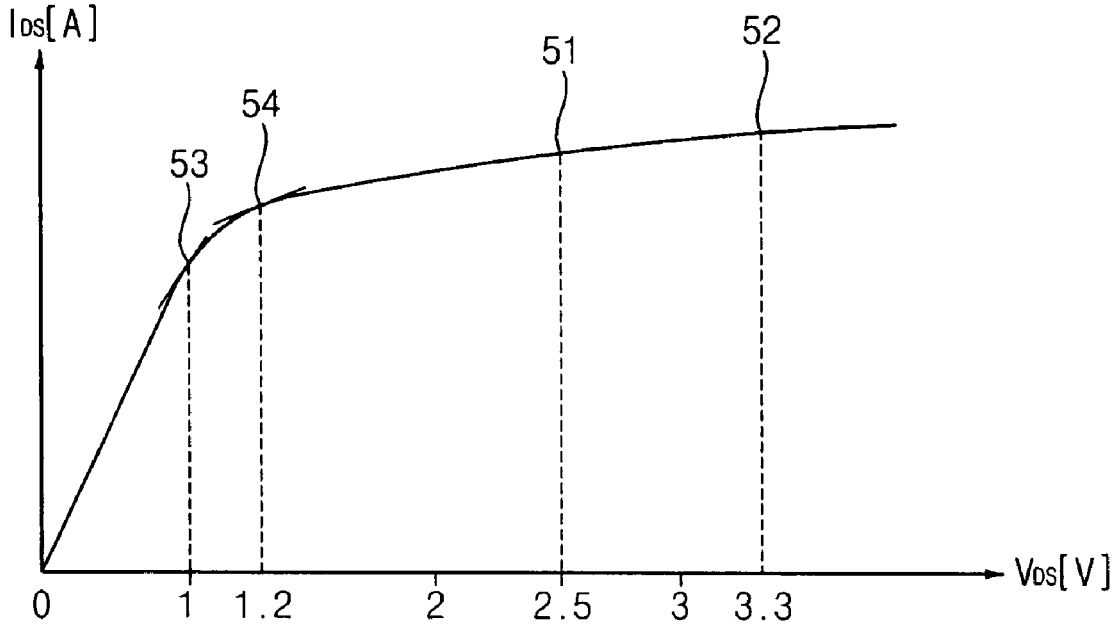
FIG. 5 is a graph showing a current-voltage property of a conventional MOS transistor when operated at a low power supply voltage.

FIG. 5 is a graph showing a current-voltage property of a typical MOS transistor when operated at a low power supply voltage. The typical MOS transistor has a given output resistance as a result of a channel length modulation of the MOS transistor. Referring to FIG. 5, the output resistance is represented as a gradient of a voltage-current curve in a voltage-current relation graph. Within a range of the power supply voltage where the typical MOS transistor operates at a saturation region, e.g. a voltage range of 2.5V~3.3V in the graph, the gradients 51 and 52 of the curve, which represent the output resistances, are relatively flat, so that properties of the transistor may be maintained steady despite variation of the power supply voltage.

However, in another range of the power supply voltage where the typical MOS transistor operates between a saturation region and a triode region, the output resistances are greatly dependent on the power supply voltage, so that a current flowing through the drain may also vary based on the variation of the power supply voltage. Here, for example, with a voltage range of 1.0V~1.2V in the graph, the gradients 53 and 54 of the curve, which represent the output resistances, are heavily depend on the power supply voltage.

In the circuit of FIG. 4, when the reference current generating circuit 400 operates at a voltage range of 1.0V~1.2V, assuming the current compensation circuit 430 is disregarded, the output current $I_{OUT}$ is dependent on the power supply voltage and may be represented by:

$$I_{OUT} = \frac{2 \times L_{MP2}}{R^2 \mu_p C_{OX} W_{MP2}} \left(1 - 1/\sqrt{A}\right)^2 + VDD/R_{O,MP1}, \quad \text{Equation (2)}$$

where the $R_{O,MP1}$ denotes an output resistance from the channel length modulation.

Within the typical range of the power supply voltage, the output resistance $R_{O,MP1}$ does not substantially affect the output current $I_{OUT}$, because the output resistance $R_{O,MP1}$ is very large. However, the output resistance $R_{O,MP1}$ becomes smaller as the power supply voltage lowers, and then the output current $I_{OUT}$ is affected. Referring to Equation 2, decreasing the output resistance $R_{O,MP1}$ faster than the power supply voltage VDD results in increasing the output current $I_{OUT}$. Therefore, in order to maintain the output current $I_{OUT}$ steady at the low power supply voltages, a term dependent on the level of the power supply voltage is necessarily removed from Equation 2 relating the output current $I_{OUT}$.

If the current compensation unit 430 is not disregarded, the output current $I_{OUT}$ may be represented by:

$$I_{OUT} = \frac{2 \times L_{MP2}}{R^2 \mu_p C_{OX} W_{MP2}} \left(1 - 1/\sqrt{A}\right)^2 + VDD/R_{O,MP1} - \frac{1}{2} \times \frac{\mu_n C_{OX} W_{MN5}}{L_{MN5}} \times (VDD - V_{GS,MP2} - V_{TH,MN5})^2, \quad \text{Equation (3)}$$

where $V_{GS,MP2}$ denotes a gate-source voltage of the second PMOS transistor 414, $V_{TH,MN5}$ denotes a threshold voltage of the fifth NMOS transistor 431.

As, shown in Equation 3, a current boosting term positively depending on the power supply voltage VDD may be considerably compensated with a current reducing term as a consequence of the use of the fifth NMOS transistor 431 as the current compensation unit 430. Because the current reducing term (which corresponds to the compensation current I3 in FIG. 4) is dependent on the power supply voltage VDD, the amplitude of the current reducing term, like the amplitude of the current boosting term, is varied according to the variation of the power supply voltage VDD.

Therefore, the constant current generator 401 may generate a substantially constant current regardless of the varying amplitude of the power supply voltage that is lower than usual. The constant current generated in such a way can be provided to an external circuit by the sixth NMOS transistor 451.

The reference current generating circuit 400 may be adapted to any application that uses a low power supply voltage and requires a reference current regardless of variation in the power supply voltage.

Figure 6A:
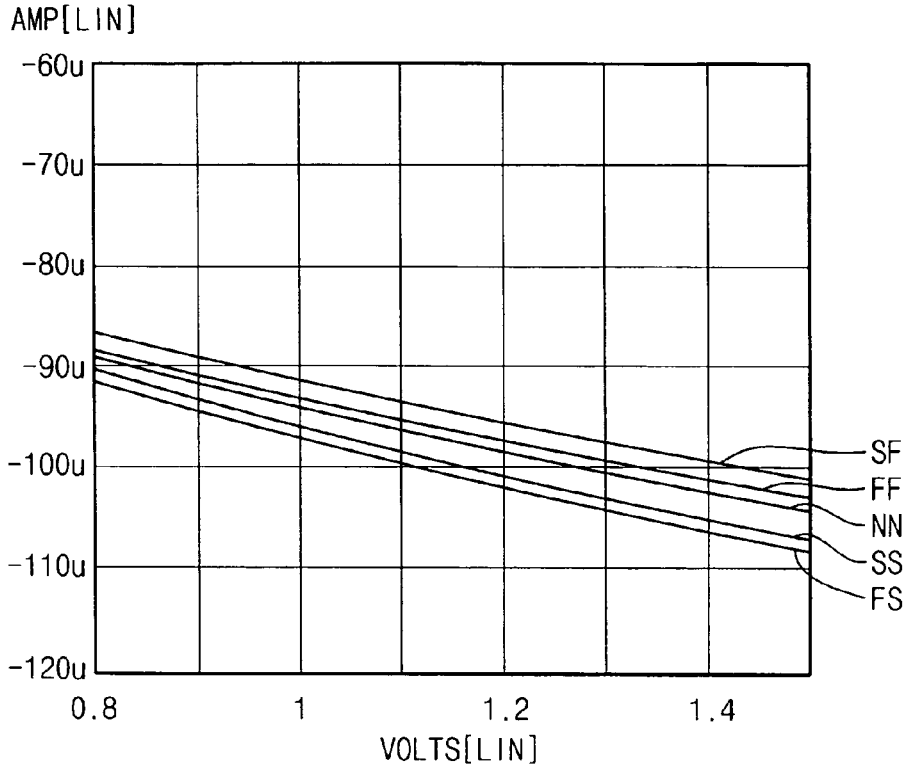
FIGS. 6A and 6B are graphs showing simulation results respectively from the conventional reference current generating circuit in FIG. 1 and the reference current generating circuit according to the example embodiments of the present disclosure in FIG. 4.
Figure 6B:
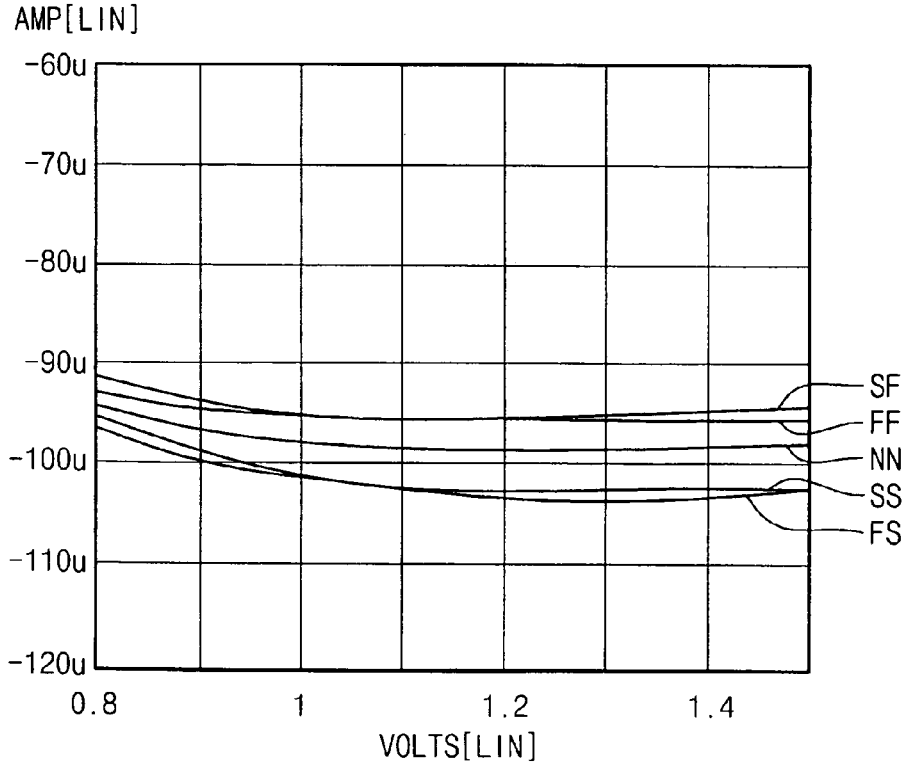

FIGS. 6A and 6B are graphs showing simulation results from the conventional reference current generating circuit 100 in FIG. 1 and the reference current generating circuit 400 of FIG. 4, respectively.

The simulation was executed using transistors having the same size, i.e. the substantially the same W/L ratio, a resistance of the feedback resistor 413 is 2.4 kΩ, and the power supply voltage VDD is varied from 0.8V to 1.5V. The simulation was repeated at five CMOS process conditions, i.e. NN, NF, SS, FS and SF, in which N stands for 'normal'; S for 'slow'; and F for 'fast.' The former character represents a process condition for NMOS and the latter character represents a process condition for PMOS. A horizontal axis as well as a vertical axis is represented on a linear scale.

Referring to FIG. 6A, in the conventional reference current generating circuit 100, a reference current increases as the power supply voltage lowers from 1.5V to 0.8V. The change of the reference current from 86 μA to 108 μA is relatively large. On the contrary, as shown in FIG. 6B, in the reference current generating circuit 400 of FIG. 4, the change in the reference current is considerably reduced down to a range of 92 μA to 102 μA, for the same range of the power supply voltages. Particularly, around a range of 1.0V to 1.2V, which is a usual low power supply voltage range, the reference current generated by the reference current generating circuit 400 is substantially maintained, while the reference current generated by the conventional reference current generating circuit varies substantially in inverse proportion to the power supply voltage.

As will be appreciated by those skilled in the art, when the MOS transistors do not operate at the saturation mode, e.g. the power supply voltage becomes much lower than about 1.0V, the above equations are incorrect and the reference current cannot be maintained.

Figure 7:
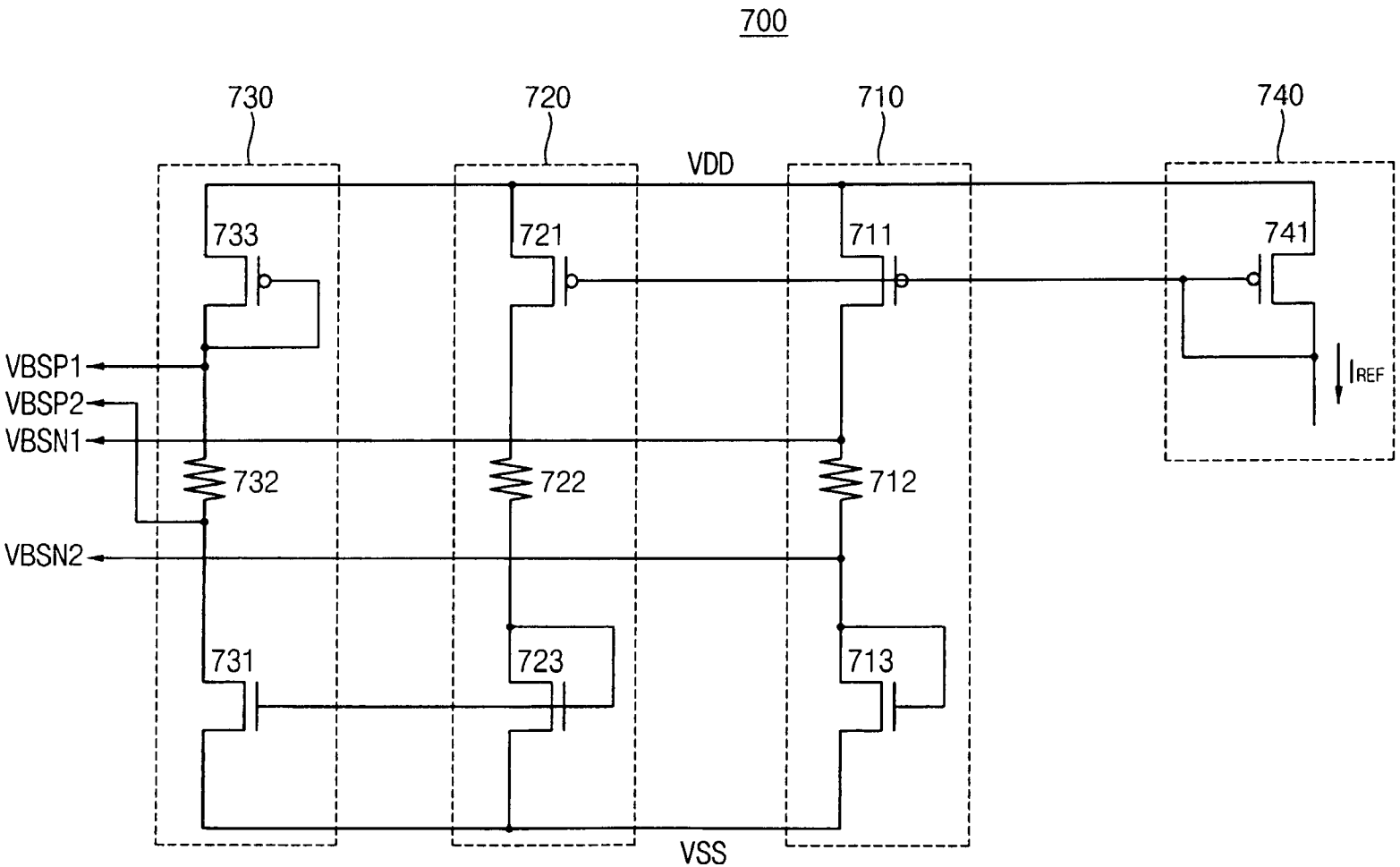
FIG. 7 is a circuit diagram illustrating a bias voltage generating circuit according to the example embodiments of the present disclosure.

FIG. 7 is a circuit diagram illustrating an exemplary embodiment of a bias voltage generating circuit 700. Referring to FIG. 7, a bias voltage generating circuit 700 includes a first branch 710 and a second branch 720 that respectively generate first and second PMOS bias voltages VBSP1 and VBSP2, a third branch 730 that generates first and second NMOS bias voltages VBSN1 and VBSN2, and a current receiving unit 740.

The first branch 710 includes a PMOS mirror transistor 711 configured to form a current mirror with a PMOS transistor 741 of the current receiving unit 740 that receives a reference current $I_{REF}$. The PMOS mirror transistor 711 generates a mirror current dependent on the reference current $I_{REF}$. When the PMOS transistor 711 has the same size as the PMOS transistor 741, the PMOS transistor 711 generates the mirror current, which is substantially similar to the reference current $I_{REF}$. The first branch 710 further includes a diode-connected load transistor 713 and a bias resistor 712 used to determine a level of the bias voltage. The mirror transistor, the bias resistor and the load transistor are coupled in serial in the first branch 712. The second and third branches 720 and 730 may have substantially the same structure as the first branch 710.

The first branch 710 forms a current mirror with the PMOS transistor 741 and generates a mirror current. A voltage level of a node that connects the mirror transistor 711 with the bias resistor 712 is maintained at a voltage level determined by subtracting a voltage level developed across the mirror transistor 711 from the power supply voltage VDD. Because the voltage level across the mirror transistor 711 is relatively small, the voltage level of the node at which the mirror transistor 711 is coupled with the bias resistor 712 is approximate to the power supply voltage VDD, and is suitable to drive an NMOS transistor. A voltage level of a node between the bias resistor 712 and the load transistor 713 may be maintained at a voltage level determined by subtracting a voltage level across the bias resistor 712 from the voltage level of the node between the mirror transistor 711 and the bias resister 712, and may be suitable to drive an NMOS transistor. Therefore, the voltage of the node between the mirror transistor 711 and the bias resister 712 may be used as the first NMOS bias voltage VBSN1, and the voltage of the node between the bias resistor 712 and the load transistor 713 may be used as the second NMOS bias voltage VBSN2.

The second branch 720 includes a mirror transistor 721, a passive load 722, and a mirror transistor 723 and operates as a buffer for delivering the reference current between the first branch 710 and the third branch 730.

The third branch 730 forms the current mirror with the NMOS mirror transistor 721 and generates a mirror current. A voltage level of a node that connects the mirror transistor 731 to the bias resistor 732, may be maintained at a voltage level determined by subtracting a voltage level across the mirror transistor 731 from the reference voltage VSS. Because the voltage level across the mirror transistor 731 is relatively small, the voltage level of the node between the mirror transistor 731 and the bias resistor 732 is approximate to the reference voltage VSS, and is suitable to drive a PMOS transistor. A voltage level of a node that connects the bias resistor 732 and the load transistor 733, may be maintained at a voltage level determined by adding a voltage level across the bias resistor 732 to the voltage level of the node that connects the mirror transistor 731 to the bias resister 732, and is also suitable to drive an NMOS transistor. Therefore, the voltage of the node between the mirror transistor 731 and the bias resister 732 may be used as the first PMOS bias voltage VBSP1. And the voltage of the node between the bias resistor 732 and the load transistor 733 may be used as the second PMOS bias voltage VBSP2.

Figure 8:
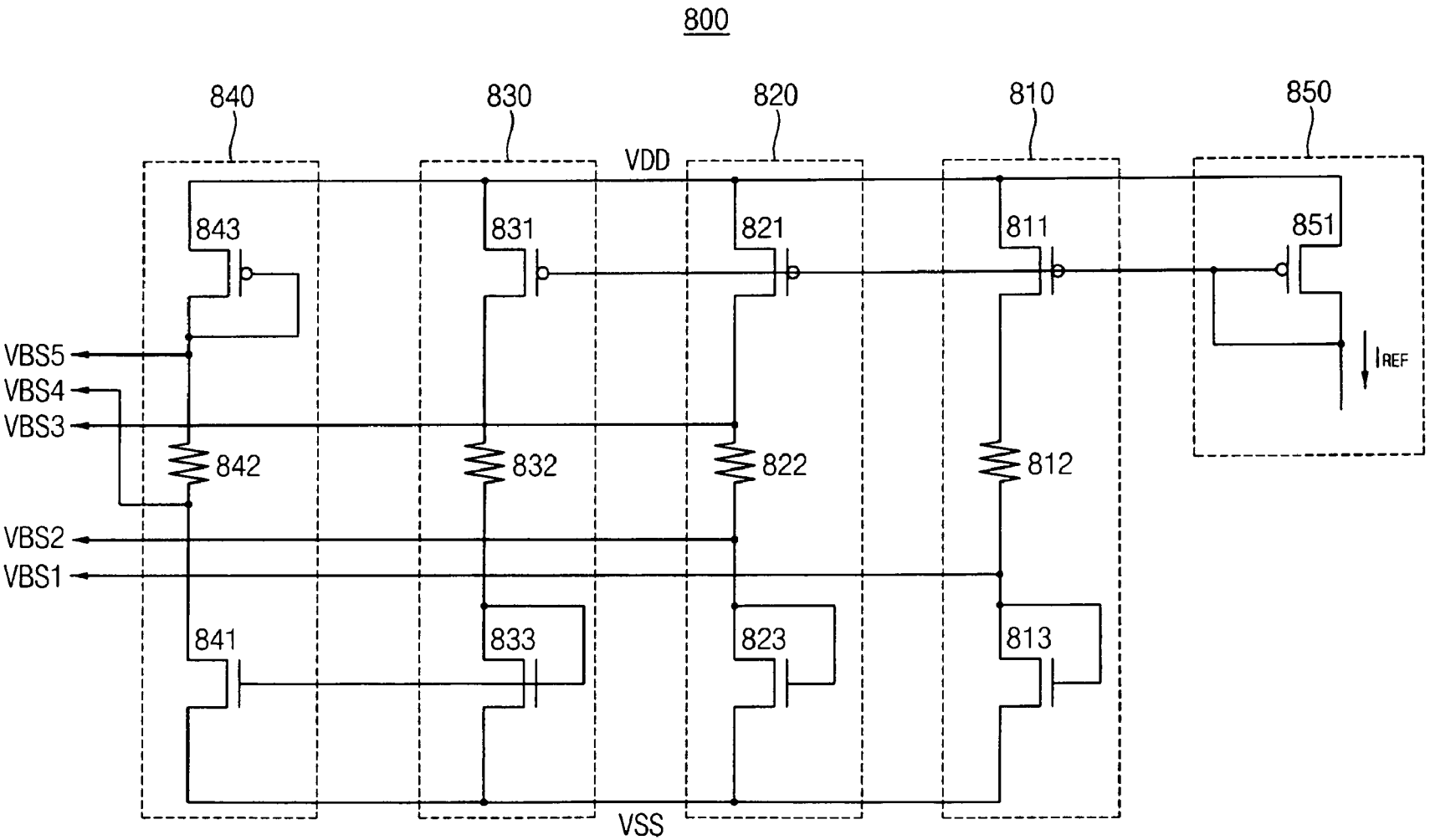
FIG. 8 is a circuit diagram illustrating a bias voltage generating circuit according to another example embodiment of the disclosure.

FIG. 8 is a circuit diagram illustrating an exemplary embodiment of a bias voltage generating circuit 800. Referring to FIG. 8, the bias voltage generating circuit 800 includes a first branch 810 configured to generate a first bias voltage VBS1, a second branch 820 configured to generate second and third bias voltages VBS2 and VBS3, a third branch 830, a fourth branch 840 configured to generate fourth and fifth bias voltages VBS4 and VBS5, and a current receiving unit 850.

The first, second and third branches 810, 820 and 830 respectively include PMOS transistors 811, 821 and 831, each of which forms a current mirror with a PMOS transistor 851 of the current receiving unit 850. The PMOS transistors 811, 821 and 831 respectively generate mirror currents dependent on the reference current IREF. Having the same size as that of the PMOS transistor 851, the PMOS transistors 811, 821 and 831 may respectively generate substantially the same amount of current as that of the reference current IREF. The first, second and third branches 810, 820, and 830, as well as the fourth branch 840, respectively include diode-connected load transistors, which are used as active loads, and also include bias resistors 812, 822, 832, and 842, as passive loads to determine voltage levels of the bias voltages. The mirror transistors, the bias resistors and the load transistors in the respective branches are respectively coupled in serial.

The first branch 810 forms a current mirror with the PMOS transistor 851 and generates a mirror current. A voltage level of a node where the load transistor 813 connects itself to the bias resistor 812 is maintained at a voltage level determined by subtracting the power supply voltage VDD from the voltage across the mirror transistor 811 and the bias resistor 812. Being suitable to stably drive a PMOS transistor, the voltage level of a node where the load transistor 813 connects itself to the bias resistor 812 may be used as the first bias voltage.

The second branch 820 forms a current mirror with the PMOS transistor 851 and generates a mirror current. Accordingly, the third bias voltage VBS3 is at a level substantially the same as that of the power supply voltage VDD. The second bias voltage VBS2 is at a level substantially the same as that of a voltage determined by subtracting a voltage level across the bias resistor 822 from the voltage level of the third bias voltage VBS3.

The fourth branch 840 forms a current mirror with an NMOS transistor 833 in the third branch 830 and generates a mirror current, which may be substantially the same as the reference current $I_{REF}$. The fourth bias voltage VBS4 has a level substantially the same as that of the reference voltage VSS. The fifth bias voltage VBS5 is in a level substantially the same as that determined by adding a voltage across the bias resistor 842 to the fourth bias voltage VBS4.

Figure 2:
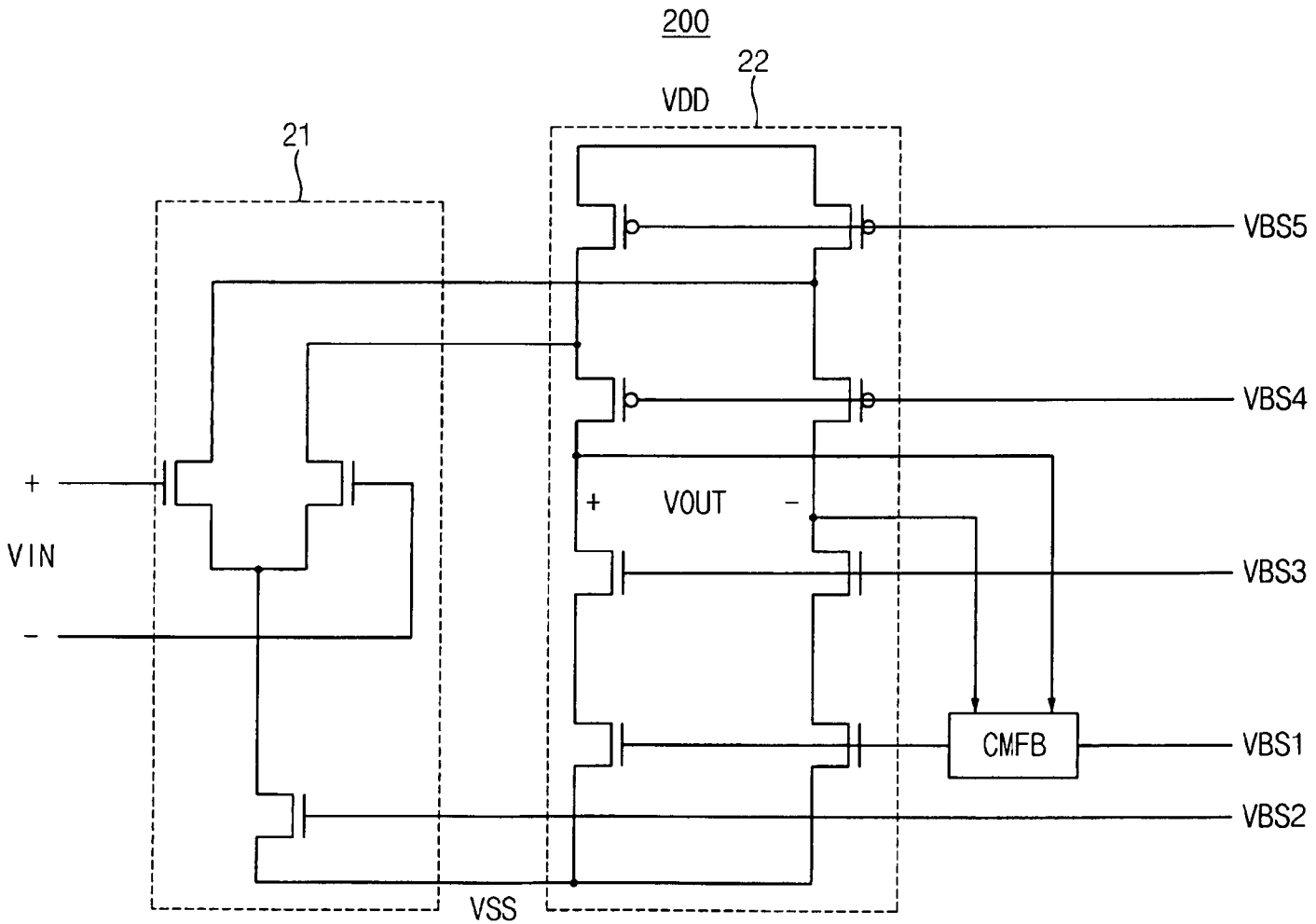
FIG. 2 (PRIOR ART)
FIG. 2 is a schematic diagram illustrating a conventional operational amplifier.

The fourth and fifth bias voltages VBS4 and VBS5 are bias voltages for PMOS transistors, as shown in FIG. 2, and should be close to the reference voltage VSS to turn on the PMOS transistors, rather than being close to the power supply voltage VDD. The third branch 830 is a buffer for delivering the reference current between the second branch 820 and the fourth branch 840.

Figure 3:
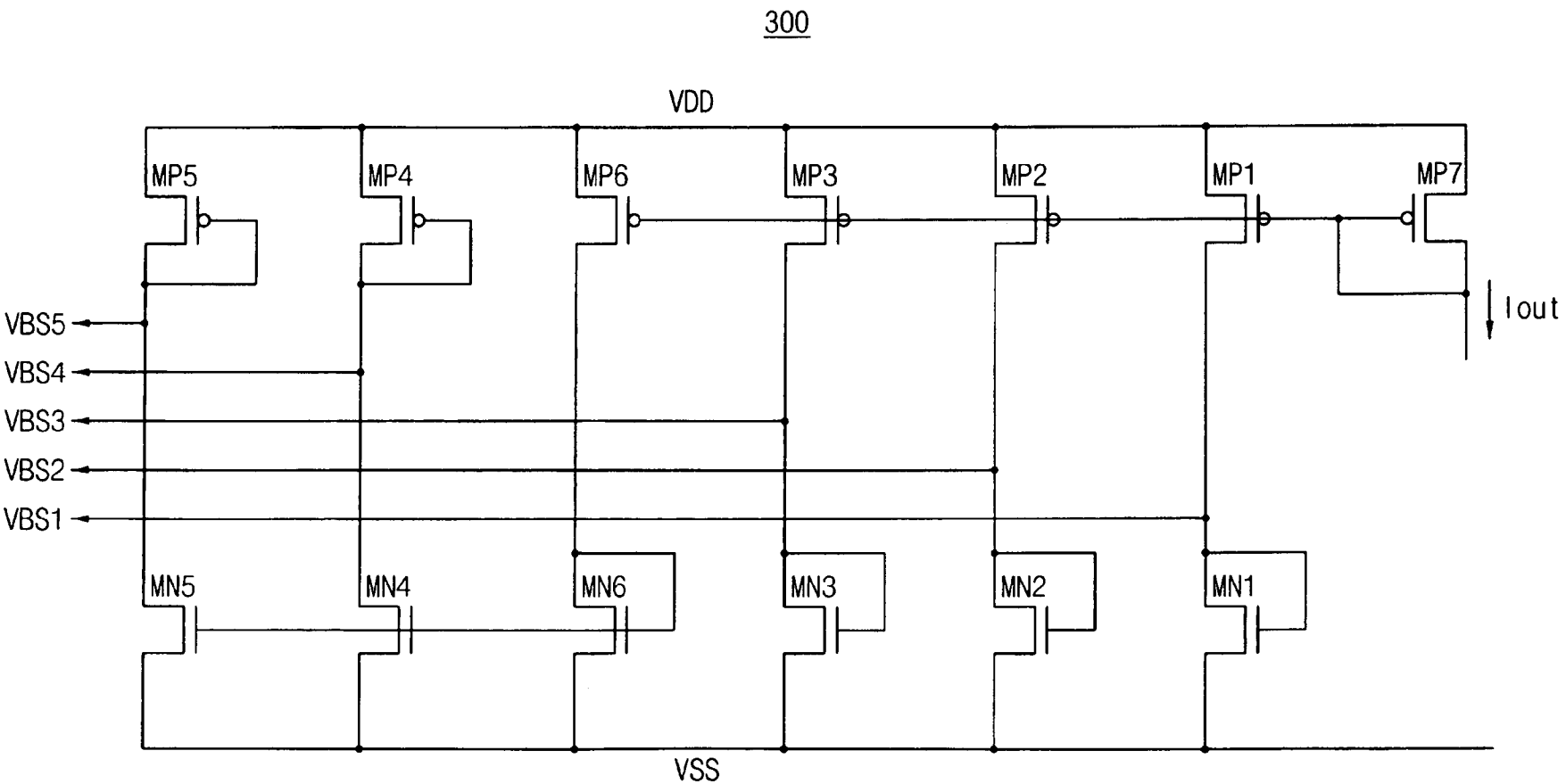
FIG. 3 (PRIOR ART)
FIG. 3 is a circuit diagram illustrating a bias voltage generating circuit for the conventional operational amplifier in FIG. 2.

While the conventional bias voltage generating circuit 300 of FIG. 3 generates the bias voltages depending on the size of load transistor, the bias voltage generating circuit 800 of FIG. 8 generates the bias voltages based on a voltage across the bias resistor. The typical op-amps have a difference between the first bias voltage and the second bias voltage, a difference between the third bias voltage and the fourth bias voltage, and a difference between the third bias voltage and the fifth bias voltage. In the exemplary embodiments, the differences of the bias voltages are directly obtained from the voltages across the bias resistors, so that the bias voltages may be more preciously generated.

The above bias voltage generating circuit 800 may be adapted to any application using a low power supply voltage and requiring a reference current regardless of variation of the power supply voltage.

Figure 9:
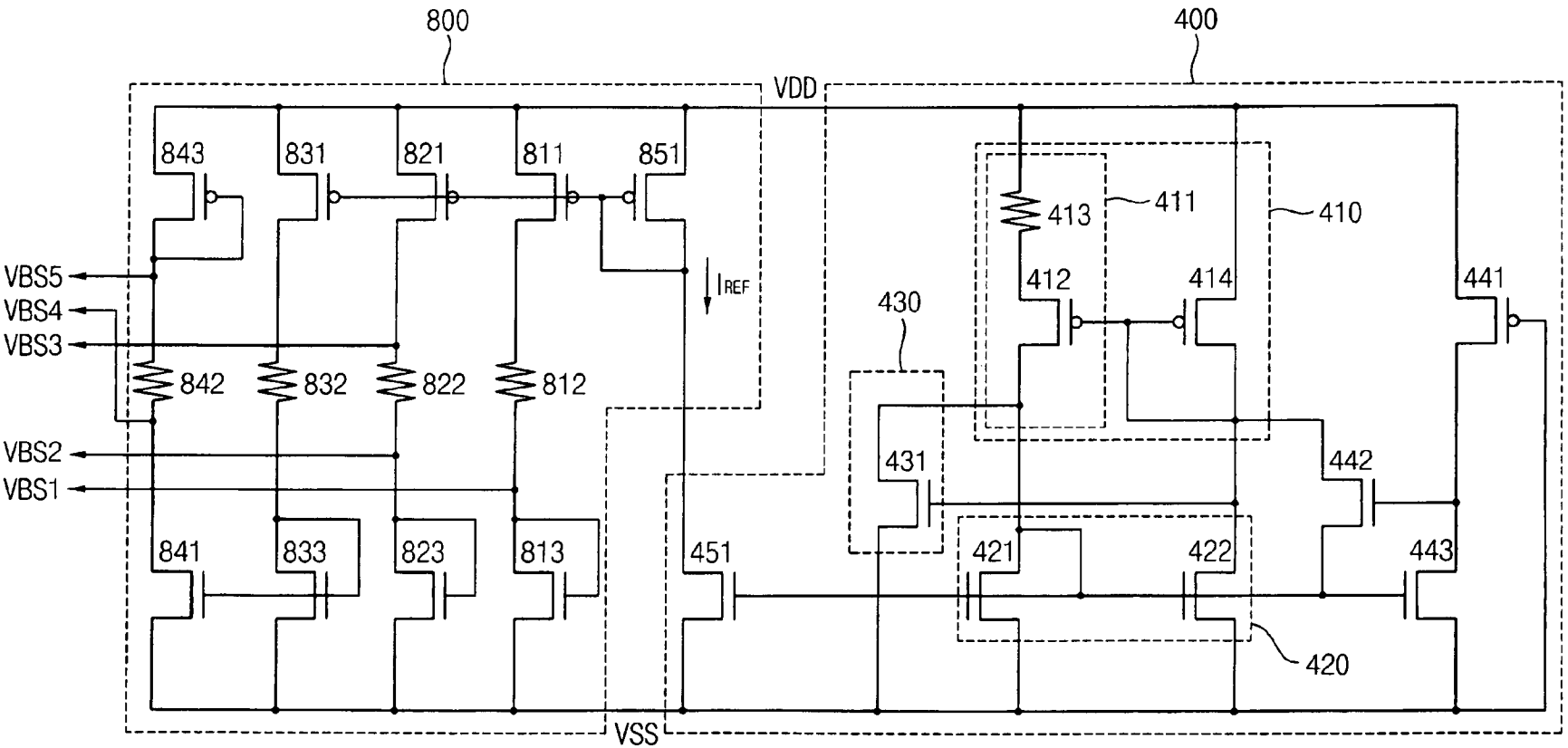
FIG. 9 is a circuit diagram illustrating an amplifier bias circuit according to the example embodiments of the present disclosure.

FIG. 9 is a circuit diagram illustrating an exemplary embodiment of an amplifier bias circuit 900. The amplifier bias circuit 900 may be illustrated as a circuit in which the reference current generating circuit 400 is integrated with or coupled to the bias voltage generating circuit 800 in order to provide an op-amp with the bias voltages. That is, the reference current generating circuit 400 generates the reference current, which is independent of the power supply voltage, but is slightly positively dependent on the temperature. The bias voltage generating circuit 800 generates the bias voltages, which are independent of the power supply voltage, based on the reference current and provides the bias voltages to the op-amp.

In the conventional amplifier bias circuit, the difference between any two bias voltages is substantially proportional to a value determined by taking the square root of the reference current and a measure of an influence of the channel length modulation, which can be expressed by:

$$V_{BS1}-V_{BS2}\propto\sqrt{I_{REF}}+\alpha, \qquad \text{Equation (4)}$$

where $\alpha$ denotes the measure of the influence of the channel length modulation.

As shown in FIG. 5, $\alpha$ may be negligible when the conventional amplifier circuit is operated within a usual range of the power supply voltage. As the power supply voltage becomes lower, $\alpha$ becomes relatively large. Therefore, in the conventional amplifier bias circuit, the differences between the bias voltages are very sensitive to the range of the power supply voltage, because the reference current is originally dependent on the power supply voltage, and there is an effect from the channel length modulation.

On the contrary, in the amplifier bias circuit 900 embodiment of FIG. 9, the differences between the bias voltages are substantially proportional to the reference current, as follows.

$$V_{BS1} - V_{BS4} = I_{REF} \times R_{842}, \quad \text{Equation (5)}$$
$$I_{REF} \propto 1/R_{413}^2,$$
$$R_{413} = R_{842}$$
$$\therefore V_{BS5} - V_{BS4} = I_{REF} \times 1/\sqrt{I_{REF}} \propto \sqrt{I_{REF}},$$

where $R_{842}$ denotes a resistance of the passive load 842 in FIG. 8, and $R_{413}$ denotes a resistance of the feedback resistor 413 in FIG. 4.

Referring to Equation 5, a bias voltage difference (VBS5–VBS4) is equal to a value determined by multiplying the reference current $I_{REF}$ with the resistance R842 of the passive load 842. The reference current $I_{REF}$, which is the output current $I_{OUT}$ from the circuit in FIG. 4, is in inverse proportion to a square of the resistance R413 of the feedback resistance 413. When the resistance of the passive load 842 is equal to or proportional to that of the feedback resistor 413, the bias voltage difference is substantially proportional to a square root of the reference current $I_{REF}$. In other words, where the reference current is maintained, the bias voltage difference may also be maintained. Therefore, the amplifier bias circuit 900, which includes the reference current generating circuit and the bias current generating circuit according to the exemplary embodiments of the present disclosure, may provide stable bias voltages to the op-amp even at the low power supply voltage at which the conventional bias circuit cannot supply the stable bias voltages.

The above bias circuit may be adapted to any application, which uses a low power supply voltage and requires a reference current substantially independent of variation of the power supply voltage.

Figure 10:
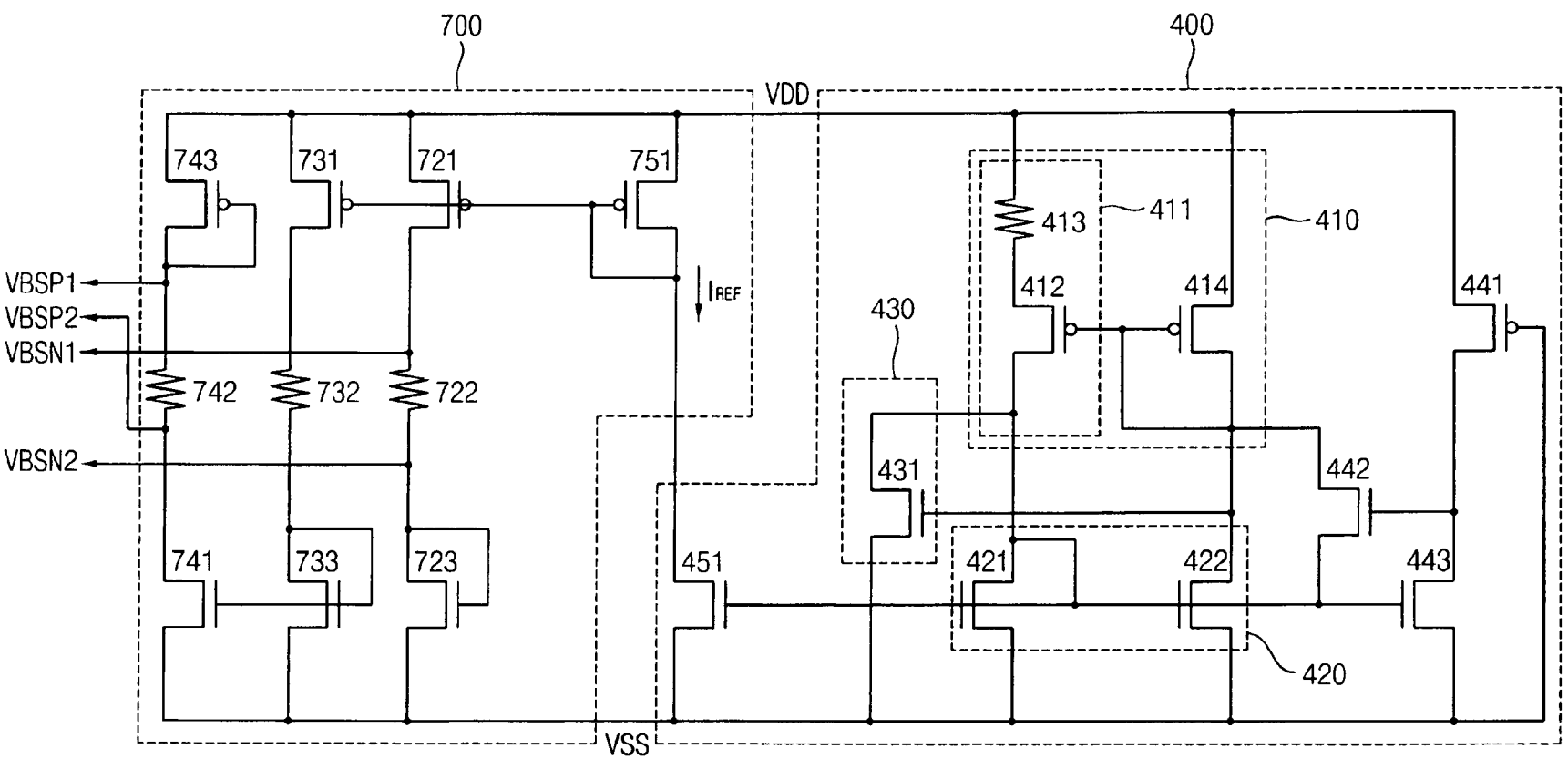
FIG. 10 is a circuit diagram illustrating an amplifier bias circuit according to another example embodiment of the disclosure.

FIG. 10 is a circuit diagram illustrating another exemplary embodiment of an amplifier bias circuit 1000. In the amplifier bias circuit of FIG. 10 the reference current generating circuit 400 of FIG. 4 is integrated with or coupled to the bias voltage generating circuit 700 of FIG. 7. The operation of the amplifier bias circuit 1000 in FIG. 10 is substantially similar to that of the amplifier bias circuit 900 of FIG. 9, hence any further explanation is omitted. The above amplifier bias circuit 1000 may also be adapted to any application, which uses a low power supply voltage and requires a reference current independent of variation of the power supply voltage.

The reference current generating circuit according to the example embodiments of the present disclosure may generate a reference current substantially constantly at a low power supply voltage, regardless of variation of the power supply voltage, without developing new processes. The bias voltage generating circuit according to the example embodiments can generate bias voltages substantially constantly at the low power supply voltage with the similar size and process of the conventional bias voltage generating circuit. In the bias voltage generating circuit, differences of the bias voltages are determined based on the resistances of the bias resistors rather than the sizes of the active load transistors, to maintain the differences of the bias voltages more precisely.

According to the preferred exemplary embodiments of the present disclosure, the amplifier bias circuit including the reference current generating circuit and the bias voltage generating circuit may stably provide the bias voltages to an op-amp even at the low power supply voltage.

The foregoing preferred exemplary embodiments are illustrative of the present invention and not to be construed as limiting thereof. Those skilled in the art will readily appreciate that many modifications are possible in the exemplary embodiments without materially departing from the novel teachings and advantages of this invention. Accordingly, all such modifications are intended to be included within the scope of this invention as defined in the claims.

The invention is defined by the following claims, claim that which is literally described and all equivalents thereto, including all modifications and variations that fall within the scope of each claim.

What is claimed is:

1. A circuit for generating bias voltages comprising:

an input transistor configured to receive a reference current;

at least one bias branch, configured to generate the bias voltages, including:

a first load;

a second load that is coupled in serial with the first load; and a mirroring transistor configured to form a current mirror with the input transistor and configured to provide the first and second loads with a mirror current that is dependent on the reference current, wherein the bias voltages are respectively output from one or more of a junction of the first load and the mirroring transistor and a junction of the first load and the second load; and a reference current generating circuit for generating the reference current, including:

a first current mirror configured to current-mirror based on a second current, so as to generate a first current that is substantially in inverse proportion to variation of a power supply voltage;

a current compensation unit configured to compensate the first current by removing a variation of the first current corresponding to the variation of the power supply voltage;

a second current mirror configured to generate the second current based on the compensated first current, and configured to provide the second current to the first current mirror; and a current output unit configured to output the second current as the reference current.

2. The circuit of claim 1, wherein the current compensation unit is configured to substantially remove an increment of the first current that increases in inverse proportion to the power supply voltage.

3. The circuit of claim 2, wherein the first current mirror comprises:

a first PMOS transistor having a body coupled to its own source;

a feedback resistor coupled between the source of the first PMOS transistor and the power supply voltage; and a second PMOS transistor having a gate and a drain both coupled to a gate of the first PMOS transistor, and a source coupled to the power supply voltage.

4. The circuit of claim 3, wherein the second current mirror comprises:

a third NMOS transistor having a gate and a drain both coupled to a drain of the first PMOS transistor, and a source coupled to a reference voltage; and a fourth NMOS transistor having a gate coupled to the gate of the third NMOS transistor, a drain coupled to the drain of the second PMOS transistor, and a source coupled to the reference voltage.

5. The circuit of claim 4, wherein the current compensation unit comprises a fifth NMOS transistor having a gate coupled to the drain of the second PMOS transistor, a drain coupled to the drain of the first PMOS transistor, and a source coupled to the reference voltage.

6. The circuit of claim 5, wherein the reference current generating circuit is provided with the power supply voltage and the power supply voltage is provide within a range between the saturation region and the triode region of the PMOS transistors and the NMOS transistors.

7. The circuit of claim 1, wherein the reference current generating circuit further comprises a start-up unit configured to activate the first current mirror and the second current mirror after power-up.

8. The circuit of claim 1, further comprising:

an additional bias branch, and a buffer branch configured to deliver a current based on the reference current from one bias branch to another bias branch by current-mirroring the current.

9. The circuit of claim 8, wherein the bias branches include first, second and third bias branches, and wherein the first bias branch includes a first mirroring transistor that forms a current mirror with the input transistor to provide a first mirror current that is dependent on the reference current, for a first passive load and a first active load that is coupled in serial with the first passive load, wherein the first branch outputs a first bias voltage from a junction of the first passive load and the first active load;

the second bias branch includes a second mirroring transistor that forms a current mirror with the input transistor to provide a second mirror current that is dependent on the reference current, for a second passive load and a second active load that is coupled in serial with the second passive load, wherein the second branch outputs a second bias voltage from a junction of the second passive load and the second active load and a third bias voltage from a junction of the second passive load and the second mirroring transistor;

the buffer branch includes a third mirroring transistor that forms a current mirror with the input transistor to provide a third mirror current that is dependent on the reference current for a third passive load and a third active load coupled in serial with the third passive load; and the third bias branch includes a fourth mirroring transistor that forms a current mirror with the third active load to provide a fourth mirror current that is dependent on the third mirror current with a fourth passive load and a fourth active load that is coupled in serial with the fourth passive load, wherein the fourth branch outputs a fourth bias voltage from a junction of the fourth passive load and the fourth active load and a fifth bias voltage from a junction of the fourth passive load and the fourth mirroring transistor.

10. A circuit for generating bias voltages comprising:

an input transistor configured to receive a reference current;

at least one bias branch, configured to generate the bias voltages, including:

a first load;

a second load that is coupled in serial with the first load; and a mirroring transistor configured to form a current mirror with the input transistor and configured to provide the first and second loads with a mirror current that is dependent on the reference current, wherein the bias voltages are respectively output from one or more of a junction of the first load and the mirroring transistor and a junction of the first load and the second load; and a reference current generating circuit for generating the reference current, including:

a current generating unit including a self-biased current source that generates a first current that varies substantially in inverse proportion to a variation of a power supply voltage; and a current compensation unit configured to remove a variation of the first current corresponding to the variation of the power supply voltage to form a compensated first current, and to thereby provide the compensated first current as the reference current.

11. The circuit of claim 10, wherein the current compensation unit is configured to substantially remove an increment of the first current that increases in inverse proportion to the power supply voltage.

12. The circuit of claim 11, wherein the current generating unit comprises:

a first PMOS transistor having a body coupled to its own source;

a feedback resistor coupled between the source of the first PMOS transistor and the power supply voltage; and a second PMOS transistor having a gate and a drain both coupled to a gate of the first PMOS transistor, and a source coupled to the power supply voltage.

13. The circuit of claim 12, wherein the reference current generating circuit further comprises:

a third NMOS transistor having a gate and a drain both coupled to a drain of the first PMOS transistor, and a source coupled to a reference voltage; and a fourth NMOS transistor having a gate coupled to the gate of the third NMOS transistor, a drain coupled to the drain of the second PMOS transistor, and a source coupled to the reference voltage.

14. The circuit of claim 13, wherein the current compensation unit comprises a fifth NMOS transistor having a gate coupled to the drain of the second PMOS transistor, a drain coupled to the drain of the first PMOS transistor, and a source coupled to the reference voltage.

15. The circuit of claim 14, wherein the reference current generating circuit is provided with the power supply voltage, and the power supply voltage is provided within a range between the saturation region and the triode region of the PMOS transistors and the NMOS transistors.

16. The circuit of claim 10, wherein the reference current generating circuit further comprises a start-up unit configured to activate the first current mirror and the second current mirror right after a power-up.

17. The circuit of claim 10, further comprising:

an additional bias branch, and a buffer branch configured to deliver a current based on the reference current from one bias branch to another bias branch by current-mirroring the current.

18. The circuit of claim 17, wherein the bias branches include first, second and third bias branches, and wherein the first bias branch includes a first mirroring transistor that forms a current mirror with the input transistor to provide a first mirror current that is dependent on the reference current, for a first passive load and a first active load that is coupled in serial with the first passive load, wherein the first branch outputs a first bias voltage from a junction of the first passive load and the first active load;

the second bias branch includes a second mirroring transistor that forms a current mirror with the input transistor to provide a second mirror current that is dependent on the reference current, for a second passive load and a second active load that is coupled in serial with the second passive load, wherein the second branch outputs a second bias voltage from a junction of the second passive load and the second active load and a third bias voltage from a junction of the second passive load and the second mirroring transistor;

the buffer branch includes a third mirroring transistor that forms a current mirror with the input transistor to provide a third mirror current that is dependent on the reference current for a third passive load and a third active load coupled in serial with the third passive load; and the third bias branch includes a fourth mirroring transistor that forms a current mirror with the third active load to provide a fourth mirror current that is dependent on the third mirror current with a fourth passive load and a fourth active load that is coupled in serial with the fourth passive load, wherein the fourth branch outputs a fourth bias voltage from a junction of the fourth passive load and the fourth active load and a fifth bias voltage from a junction of the fourth passive load and the fourth mirroring transistor.

* * * * *

UNITED STATES PATENT AND TRADEMARK OFFICE

CERTIFICATE OF CORRECTION

PATENT NO. : 7,495,507 B2
APPLICATION NO. : 11/508428
DATED : February 24, 2009
INVENTOR(S) : Hee-Cheol Choi It is certified that error appears in the above-identified patent and that said Letters Patent is hereby corrected as shown below:

Column 6, line 37 add --first-- in front of "PMOS"

Signed and Sealed this

Twelfth Day of May, 2009

JOHN DOLL
*Acting Director of the United States Patent and Trademark Office*